United States Patent [19]

Ogawa et al.

[11] 4,396,708

[45] Aug. 2, 1983

[54] PHOTOGRAPHIC LIGHT-SENSITIVE MATERIAL CONTAINING ANTISTATIC ACID POLYMER

[75] Inventors: Masashi Ogawa; Kunio Ishigaki; Taku Nakamura, all of Kanagawa, Japan

[73] Assignee: Fuji Photo Film Co., Ltd., Kanagawa, Japan

[21] Appl. No.: 388,301

[22] Filed: Jun. 14, 1982

[30] Foreign Application Priority Data

Jun. 12, 1981 [JP] Japan ..... 56/90435

[51] Int. Cl.[3] ..... G03C 1/78

[52] U.S. Cl. ..... 430/529; 430/527; 430/531

[58] Field of Search ..... 430/527, 529, 531

[56] References Cited

U.S. PATENT DOCUMENTS 4,147,550 4/1979 Campbell et al. ..... 430/529

4,268,623 5/1981 Sera et al. ..... 430/631

*Primary Examiner*—Jack P. Brammer

*Attorney, Agent, or Firm*—Sughrue, Mion, Zinn, Macpeak and Seas

[57] ABSTRACT

A photographic light-sensitive material having at least one antistatic layer which contains gelatin and an antistatic agent. The antistatic agent being a polymer which is prepared by copolymerization of carboxylic acid group-containing monomers and monomers having such a functional group which reacts with gelatin resulting in the characteristic of greatly improved diffusion resistance.

7 Claims, No Drawings

PHOTOGRAPHIC LIGHT-SENSITIVE MATERIAL CONTAINING ANTISTATIC ACID POLYMER

FIELD OF THE INVENTION

The present invention relates to a photographic light-sensitive material with improved antistatic properties and, more particularly, to a photographic light-sensitive material having an antistatic layer which contains an antistatic agent prepared by copolymerizing a monomer having a carboxylic acid group, and a monomer having a reactive group to gelatin, resulting in greatly improved diffusion resistance.

BACKGROUND OF THE INVENTION

Accumulation of static charges on a photographic light-sensitive material has been a serious problem. Such static charges are generated by handling photographic light-sensitive material during production and use, e.g., when winding a roll, rewinding, conveying with a roller, and by contact with other things when conveying. The mechanism of generation of such static charges and the accumulated state of the charges depends on factors such as the conductivity of the particular photographic light-sensitive material. Factors which affect static charge characteristics include the position thereof in the charging series, the water content therein, the nature of materials cioming into contact therewith and the atmosphere under which the photographic material is placed. The accumulated charges are occasionally discharged and cause irregular fog.

In certain circumstances, the creation of static charges causes a fatal defect in a photographic light-sensitive material depriving the photographic light-sensitive material of its value. For instance, if only a slight amount of fog is generated in a medical Roentgen film due to the above-described phenomenon, it makes it entirely impossible to achieve its desired end. Furthermore, it can lead to a wrong diagnosis.

Providing a photographic light-sensitive material with an antistatic layer in order to aid in the elimination of these undesirable influences due to accumulation of static charges is well known. Namely, a conductive layer provided in a photographic light-sensitive material causes static charges to be scattered and lost. Accordingly, negative influences of static charges on the photographic material are evaded. For this purpose, a number of materials have been proposed. For example, U.S. Pat. Nos. 2,649,374; 3,033,679; 3,437,487; 3,525,621; 3,630,740 and 3,681,070 disclose various kinds of antistatic agents, antistatic layers containing such agents, and so on.

However, the use of such agents and layers have their respective serious defects as a constituent element of a photographic light-sensitive material. For example, an antistatic layer cannot prevent discharge fog from occurring in a highly sensitive photographic light-sensitive material. In another case, an antistatic agent incorporated in an antistatic layer undergoes diffusion into its adjacent layers and exerts adverse effects (e.g., increase in fog, decrease in sensitivity, etc.) upon photographic properties. In still another case, an antistatic layer undergoes elution into a development-processing solution creating scum in the solution. In a further case, an antistatic layer itself tends to get scratches and has low durability, or the film strength of a photographic light-sensitive material is lowered by the presence of an antistatic layer. Accordingly, the finished material is subject to being scratched and its durability is lowered. This results in loss of value as a commodity or the occurrence of difficulties during manufacturing.

In order to eliminate the above-described defects, British Pat. No. 1,496,027 proposes an antistatic layer which contains (a) an anionic macromolecular electrolyte of a water-soluble film-forming polymer having a free acid form (e.g., polystyrenesulfonic acid), (b) a binder of a film-forming, water-soluble, cross-linkable polymer (e.g., polyvinyl alcohol) and (c) a cross-linking agent for the above-described binder polymer (e.g., glyoxal).

However, in the above-described patent the water-soluble anionic macromolecular electrolyte is fixed in a network formed by the binder and the cross-linking agent. Therefore, elution of the water-soluble, conductive, anionic macromolecular electrolyte upon development-processing occurs to some extent. Accordingly, the lowering of pH and generation of scum in the development-processing bath cannot be evaded. In addition, the content of the anionic macromolecular electrolyte in the antistatic layer is about $\frac{1}{3}$ to $\frac{1}{2}$ of the total weight of the antistatic layer. More specifically, a component not entering the cross-linking occupies $\frac{1}{3}$ to $\frac{1}{2}$ the weight of the whole components of the antistatic layer. This results in insufficiency of the physical strength of the layer, which is a serious problem to be overcome in the manufacturing of a photographic light-sensitive material, especially in high speed manufacturing.

In order to remedy the above-described disadvantage, U.S. Pat. No. 4,268,623 proposes an antistatic layer containing (a) gelatin, (b) a carboxylic acid group-containing, film-forming, water-soluble polymer and (c) a carboxylic acid-activated type of condensing agent.

However, in some cases, the effect intended by the above-described patent cannot be fully exhibited because the cross-linking reaction among gelatin, an antistatic agent (carboxylic acid polymer) and a carboxylic acid-activated type of condensing agent is affected by manufacturing conditions or preserving conditions.

SUMMARY OF THE INVENTION

Therefore, a first object of the present invention is to provide a photographic light-sensitive material which does not develop a static charge.

A second object of the present invention is to provide a photographic light-sensitive material having an antistatic layer which contains an antistatic agent with improved diffusion resistance created by using a carboxylic acid polymer having functional groups reactive with gelatin.

A third object of the present invention is to provide an effective method for imparting an antistatic property to a photographic light-sensitive material without exerting bad influences upon photographic characteristics (sensitivity, fog, etc.).

A fourth object of the present invention is to provide a photographic light-sensitive material which does not cause elution of its antistatic agent into a developing solution resulting in the generation of scum in the processing bath.

The above-described objects of the present invention are attained with a photographic light-sensitive material having at least one antistatic layer which contains a polymer having repeating units represented by the following general formula (I), and gelatin:

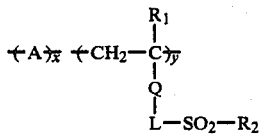

(I)

wherein A represents a repeating unit derived from a copolymerizable ethylenic unsaturated monomer which contains at least one free carboxyl group or a salt thereof; $R_1$ represents a hydrogen atom or a lower alkyl group having 1 to 6 carbon atoms; Q represents $—CO_2—$,

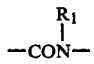

or an arylene group having 6 to 10 carbon atoms; L represents a divalent group having 3 to 15 carbon atoms and containing at least one linkage selected from the group consisting of $—CO_2—$ and

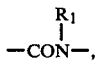

or a divalent group having 1 to 12 carbon atoms and containing at least one linkage selected from the group consisting of —O—,

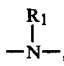

—CO—, —SO—, $—SO_2—$, $—SO_3—$,

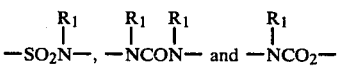

(wherein $R_1$ has the same meaning as described above); $R_2$ represents $—CH{=}CH_2$ or $—CH_2CH_2X$ (wherein X represents a group capable of being substituted with a nucleophilic group or a group capable of being released in a form of HX upon a base); and x and y represent percentages by mole fraction ranging from 50 to 99, and 1 to 50, respectively.

DETAILED DESCRIPTION OF THE INVENTION

Preferable examples of the ethylenic unsaturated monomer from which A can be derived include acrylic acid, methacrylic acid, itaconic acid, maleic acid, sodium acrylate, potassium acrylate, sodium methacrylate,

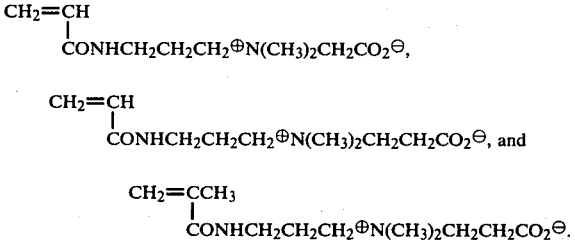

Preferable example of Q in the general formula (I) include $—CO_2—$, —CONH— and

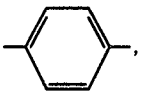

and those of L in the general formula (I) include $—CH_2NHCOCH_2CH_2—$, $—CH_2OCOCH_2CH_2—$, $—CH_2CH_2NHCOCH_2CH_2—$, $—CH_2CH_2OCOCH_2CH_2—$, $—CH_2CH_2CH_2NHCOCH_2CH_2—$, $—CH_2CH_2CH_2OCOCH_2CH_2—$, $—CH_2CH_2OCH_2CH_2—$, $—CH_2CH_2NHCOCH_2—$, $—SO_2CH_2CH_2—$ and

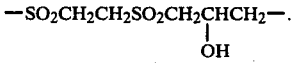

As examples of $R_1$, hydrogen atom and methyl group are especially advantageous.

As examples of $R_2$, there are $—CH{=}CH_2$, $—CH_2CH_2Cl$, $—CH_2CH_2Br$, $—CH_2CH_2O_3SCH_3$,

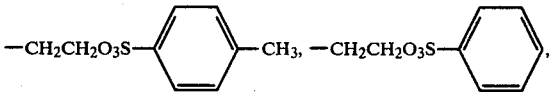

$—CH_2CH_2OH$, $—CH_2CH_2O_2CCH_3$, $—CH_2CH_2O_2CCF_3$ and $—CH_2CH_2O_2CCHCl_2$. Among these groups, $—CH{=}CH_2$, $—CH_2CH_2Br$, $—CH_2CH_2Cl$ and

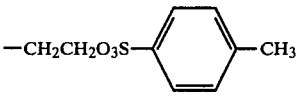

are especially advantageous.

Polymers which have the repeating units represented by the general formula (I) and that, have $R_2$ represented by $—CH_2CH_2X$ can be obtained generally by copolymerizing ethylenic unsaturated monomers, which contains at least one free carboxyl group or the salt thereof in their individual molecules and can undergo copolymerization, with another ethylenic unsaturated monomers represented by the following general formula (II). On the other hand, polymers having $R_2$ represented by $—CH{=}CH_2$ can be obtained with ease by treating the polymers having $R_2$ represented by $—CH_2CH_2X$ with a base, such as triethylamine, pyridine, sodium methoxide or the like

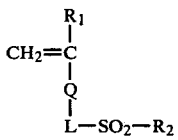

(II)

wherein $R_1$, Q, L and $R_2$ have the same meanings as in the general formula (I), respectively.

Preferable examples of the ethylenic unsaturated monomers represented by the general formula (II) include the following ones:

M-1 $CH_2{=}CH(CONHCH_2NHCH_2CH_2SO_2CH_2CH_2Cl)$

M-2 $CH_2{=}CH(CO_2CH_2CH_2OCOCH_2CH_2SO_2CH_2CH_2Cl)$

M-3 $CH_2{=}CH(CONHCH_2CH_2CH_2NHCOCH_2CH_2SO_2CH_2CH_2Cl)$

M-4

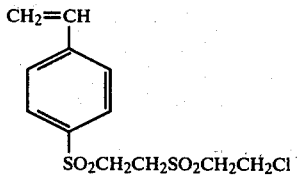

-continued

M-5

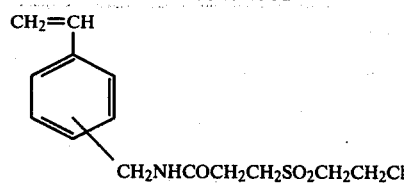

M-6

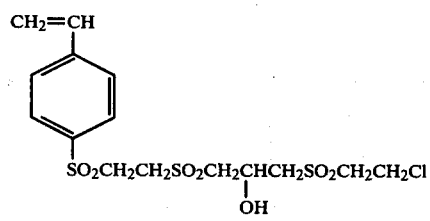

Specific examples of the polymers having the repeating units represented by the general formula (I) in the present invention are illustrated below. Among them, P-4 and P-16 are preferred.

| | | | |
|---|---|---|---|
| P-1 | $\leftarrow CH_2CH(COOH)\rightarrow_x$ | $\leftarrow CH_2CH(CONHCH_2NHCOCH_2CH_2SO_2CH{=}CH_2)\rightarrow_y$ | x/y = 92/8 |
| P-2 | $\leftarrow CH_2CH(COOH)\rightarrow_x$ | $\leftarrow CH_2CH(CONHCH_2CH_2CH_2NHCOCH_2CH_2SO_2CH{=}CH_2)\rightarrow_y$ | x/y = 95/5 |
| P-3 | $\leftarrow CH_2CH(COOH)\rightarrow_x$ | $\leftarrow CH_2CH\rightarrow_y$ 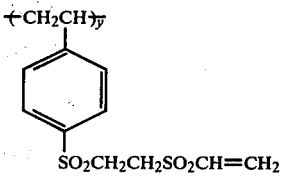 | x/y = 95/5 |
| P-4 | $\leftarrow CH_2CH(COOH)\rightarrow_x$ | $\leftarrow CH_2CH\rightarrow_y$ 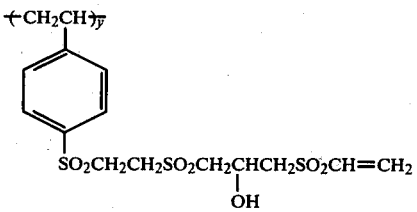 | x/y = 95/5 |
| P-5 | $\leftarrow CH_2CH(COOH)\rightarrow_x$ | $\leftarrow CH_2CH\rightarrow_y$ 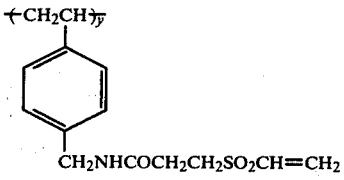 | x/y = 95/5 |
| P-6 | $\leftarrow CH_2CH(COOH)\rightarrow_x$ | $\leftarrow CH_2CH(CONHCOCH_2CH_2SO_2CH{=}CH_2)\rightarrow_y$ | x/y = 95/5 |
| P-7 | $\leftarrow CH_2CH(COOH)\rightarrow_x$ | $\leftarrow CH_2CH(CONHCH_2NHCOCH_2CH_2SO_2CH_2CH_2Cl)\rightarrow_y$ | x/y = 95/5 |

-continued

| | | | |
|---|---|---|---|
| P-8 | $\leftarrow CH_2CH \rightarrow_x$ (COOH) | $\leftarrow CH_2CH \rightarrow_y$ (C6H4) $SO_2CH_2CH_2SO_2CH_2CH(OH)CH_2SO_2CH_2CH_2Cl$ | x/y = 95/5 |
| P-9 | $\leftarrow CH_2CH \rightarrow_x$ (COOH) | $\leftarrow CH_2CH \rightarrow_y$ (C6H4) $CH_2NHCOCH_2CH_2SO_2CH_2CH_2Cl$ | x/y = 95/5 |
| P-10 | $\leftarrow CH_2CH \rightarrow_x$ (COOH) | $\leftarrow CH_2CH \rightarrow_y$ (C6H4) $SO_2CH_2CH_2SO_2CH_2CH_2Cl$ | x/y = 95/5 |
| P-11 | $\leftarrow CH(COOH)-CH(COOH) \rightarrow_x$ | $\leftarrow CH_2CH \rightarrow_y$ ($CONHCH_2NHCOCH_2CH_2SO_2CH{=}CH_2$) | x/y = 95/5 |
| P-12 | $\leftarrow CH(COOH)-CH(COOH) \rightarrow_x$ | $\leftarrow CH_2CH \rightarrow_y$ ($CONHCH_2CH_2CH_2NHCOCH_2CH_2SO_2CH{=}CH_2$) | x/y = 95/5 |
| P-13 | $\leftarrow CH(COOH)-CH(COOH) \rightarrow_x$ | $\leftarrow CH_2CH \rightarrow_y$ (C6H4) $SO_2CH_2CH_2SO_2CH{=}CH_2$ | x/y = 95/5 |
| P-14 | $\leftarrow CH(COOH)-CH(COOH) \rightarrow_x$ | $\leftarrow CH_2CH \rightarrow_y$ (C6H4) $SO_2CH_2CH_2SO_2CH_2CH(OH)CH_2SO_2CH{=}CH_2$ | x/y = 95/5 |
| P-15 | $\leftarrow CH(COOH)-CH(COOH) \rightarrow_x$ | $\leftarrow CH_2CH \rightarrow_y$ (C6H4) $CH_2NHCOCH_2CH_2SO_2CH{=}CH_2$ | x/y = 95/5 |
| P-16 | $\leftarrow CH_2-CH(CH_3) \rightarrow_x$ | $\leftarrow CH_2CH \rightarrow_y$ ($CONHCH_2NHCOCH_2CH_2SO_2CH_2CH_2Cl$) | x/y = 95/5 |
| P-17 | $\leftarrow CH(COOH)-CH(COOH) \rightarrow_x$ | $\leftarrow CH_2CH \rightarrow_y$ ($CONHCH_2NHCOCH_2CH_2SO_2CH_2CH_2Cl$) | x/y = 95/5 |

-continued

| | | | |
|---|---|---|---|
| P-18 | $\leftarrow CH(COOH)-CH(COOH)\rightarrow_x$ | $\leftarrow CH_2CH\rightarrow_y$ 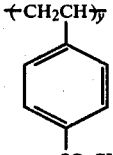 $SO_2CH_2CH_2SO_2CH_2CH(OH)CH_2SO_2CH_2CH_2Cl$ | x/y = 95/5 |
| P-19 | $\leftarrow CH(COOH)-CH(COOH)\rightarrow_x$ | $\leftarrow CH_2CH\rightarrow_y$ 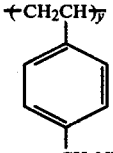 $CH_2NHCOCH_2CH_2SO_2CH_2CH_2Cl$ | x/y = 95/5 |
| P-20 | $\leftarrow CH(COOH)-CH(COOH)\rightarrow_x$ | $\leftarrow CH_2CH\rightarrow_y$ 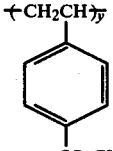 $SO_2CH_2CH_2SO_2CH_2CH_2Cl$ | x/y = 95/5 |
| P-21 | $\leftarrow CH_2CH(CONHCH_2CH_2CH_2\oplus N(CH_3)_2CH_2CH_2CO_2\ominus)\rightarrow_x$ | $\leftarrow CH_2CH(CONHCH_2NHCOCH_2CH_2SO_2CH_2CH_2Cl)\rightarrow_y$ | x/y = 95/5 |
| P-22 | $\leftarrow CH_2CH(CONHCH_2CH_2CH_2\oplus N(CH_3)_2CH_2CH_2CO_2\ominus)\rightarrow_x$ | $\leftarrow CH_2CH\rightarrow_y$ 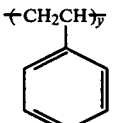 $SO_2CH_2CH_2SO_2CH_2CH(OH)CH_2SO_2CH_2CH_2Cl$ | x/y = 95/5 |
| P-23 | $\leftarrow CH_2C(CH_3)(CONHCH_2CH_2CH_2\oplus N(CH_3)_2CH_2CH_2CO_2\ominus)\rightarrow_x$ | $\leftarrow CH_2CH(CONHCH_2CH_2CH_2SO_2CH_2CH_2Cl)\rightarrow_y$ | x/y = 95/5 |
| P-24 | $\leftarrow CH_2CH(CONHCH_2CH_2CH_2\oplus N(CH_3)_2CH_2CO_2\ominus)\rightarrow_x$ | $\leftarrow CH_2CH(CONHCH_2NHCOCH_2CH_2SO_2CH_2CH_2Cl)\rightarrow_y$ | x/y = 95/5 |

Typical synthesis examples of the ethylenic unsaturated monomers having vinyl sulfone groups or such functional groups as to be the precursors thereof are illustrated in detail below.

SYNTHESIS EXAMPLE 1

Synthesis of N-{[3-(chloroethylsulfonyl)propionyl]aminomethyl}acrylamide (M-1)

In a 2 liter reaction vessel were placed 1,400 ml of distilled water, 224 g of sodium sulfite and 220 g of sodium hydrogencarbonate. With stirring, the salts were dissolved in the distilled water. The resulting solution was cooled to about 5° C. in an ice bath and thereto 260 g of chloroethanesulfonyl chloride was added dropwise over a period of 1.5 hours as the temperature of the solution was kept at about 5° C. Thereafter, 160 g of 49% sulfuric acid was added dropwise thereto in about 15 minutes, and stirring was continued at 5° C. for 1 hour. A precipitate separated out through this treatment, and was filtered off. The precipitate was washed with 400 ml of distilled water. The filtrate was placed in a 3 liter of reaction vessel together with the water used for washing. Thereto, a solution of 246 g of methylenebisacrylamide dissolved in a mixture of 480 ml of distilled water and 1,480 ml of ethanol was added dropwise over a period of 30 minutes as the vessel was cooled to approximately 5° C. in an ice bath. Thereafter, the whole was allowed to stand for 5 days in a refrigerator in order to complete the reaction. A crystal deposited was filtered off, washed with 800 ml of cooled distilled water, and recrystallized from 200 ml of 50% ethanol aqueous solution. Thus, 219 g of M-1 was obtained. The yield was 49%.

SYNTHESIS EXAMPLE 2

Synthesis of p-{2-[3-(2-chloroethylsulfonyl)-2-hydroxypropylsulfonyl]ethylsulfonyl}vinylbenzene (M-6)

In a 3 liter reaction vessel were placed 1 liter of distilled water, 1 liter of methanol and 157 g of 1,3-di(2-chloroethylsulfonyl)-2-hydroxypropane. The vessel was heated to 46° C. for the purpose of dissolution. Thereto, a solution of 52 g sodium styrenesulfinate dissolved in a mixture of 100 ml of distilled water and 100 ml of methanol was added dropwise over a period of about 1 hour, and the heating and the stirring were further continued for 5 hours. A crystal deposited was filtered off, washed with methanol, and dried in vacuo. Thus, 55 g of M-6 was obtained. The yield was 49%.

SYNTHESIS EXAMPLE 3

Synthesis of acrylic acid/N-(3-chloroethylsulfonyl)propionylaminomethylacrylamide copolymer (P-1)

In a 2 liter reaction vessel were placed 132.5 g of acrylic acid, 45.2 g of M-1, 700 ml of distilled water and 233 ml of ethanol. The mixture was heated up to 70° C. in order to dissolve the monomers in the solvents and then the temperature of the solution was altered to 60° C. Thereto, 2.2 g of 2,2'-azobis(2-amidinopropane) hydrochloride (which is on the market with trade name V-50, products of Wako Junyaku) was added, and the heating and the stirring were continued for 3 hours. After it was allowed to stand till its temperature became room temperature, it was filtered off. Thus, a P-1 solution having a solid content of 17.85% was obtained. The content of the active chlorine in this polymer solution was $5.4\times10^{-5}$ equivalent/g, and the limiting viscosity [$\eta$] of the dried P-1 was 0.622.

SYNTHESIS EXAMPLE 4

Synthesis of sodium acrylate/p-[2-(3-vinylsulfonyl-2-hydroxypropylsulfonyl)ethylsulfonyl]vinylbenzene copolymer (P-2)

In a 500 ml reaction vessel were placed 301 g of dimethylformamide (DMF), 123 g of acrylic acid and 40.1 g of M-6. The mixture was heated up to 70° C. in order to dissolve the monomers in the solvent. To the resulting solution, 0.53 g of 2,2'-azobis(2,4-dimethylvaleronitrile) was added, and after the passage of 1.5 hours, 0.53 g of 2,2'-azobis(2,4-dimethylvaleronitrile) was further added. Thereafter, the heating and the stirring were continued for about 2 hours and 30 minutes. Then, it was cooled to around 0° to 5° C. in an ice bath and thereto 54.8 g of 28% sodium methylate methanol solution was added dropwise. At the conclusion of reaction, the reaction product was allowed to stand for a while till its temperature became room temperature. Then, it was put in a cellulose tube, and subjected to dialysis over a period of 3 days, followed by lyophilization. Thus, 91 g of P-2 was obtained. The yield was 56%.

Polymers to be employed in the present invention may be optionally neutralized with alkalis. In such a case, the alkalis include alkaline earth metals, alkali metals and organic bases, preferably Na, K, Li and the like. The degree of neutralization may be changed freely as occasion demands. However, the preferable degree of neutralization is 5 to 60 mole% or so, based on the content of carboxylic acid group, and a preferable pH after neutralization ranges from 5.0 to 7.5.

The amount of the polymer to be employed in the present invention ranges from 10 wt% to 90 wt%, preferably 20 wt% to 70 wt%, to the total weight of the antistatic layer.

Gelatins which can be employed in the antistatic layer of the present invention include alkali processed gelatins, acid processed gelatins, enzyme processed gelatins and the like which have so far been used in this art. The gelatin content in the antistatic layer ranges from 10 to 90 wt%, preferably 20 to 70 wt%.

Into the antistatic layer of the present invention can be incorporated a matting agent, a slipping agent, a surface active agent, colloidal silica, a gelatin cross-linking agent, other than the cross-linking agent of the present invention, in addition to the above-described macromolecular substances.

Examples of a matting agent which can be used include beads having grain sizes of 0.1 to 10 microns which are made up of silica (silicon dioxide), polymethyl methacrylate, barium sulfate, titanium dioxide, polyolefin and so on.

Examples of a surface active agent which can be used include nonionic surface active agents such as saponin (steroid system), alkylene oxide derivatives (e.g., polyethylene glycol, polyethylene, glycol/polypropylene glycol condensate, polyethylene glycol alkyl or alkylaryl ether, polyethylene glycol esters, polyethylene glycol sorbitan esters, polyalkylene glycol alkylamines or amides, and polyethylene oxide adducts of silicone), glycidol derivatives (e.g., alkenylsuccinic acid polyglycerides, alkylphenol polyglycerides, etc.), fatty acid esters of polyhydric alcohols, alkyl esters of sugar, urethanes of sugar, ethers of sugar, and so on; anionic surface active agents containing acidic groups such as carboxylic group, sulfo group, phospho group, sulfuric acid ester group, phosphoric acid ester group and the like, with specific examples including triterpenoid series saponins, alkylcarboxylates, alkylsulfonates, alkylbenzenesulfonates, alkylnaphthalenesulfonates, alkylsulfuric acid esters, alkylphosphoric acid esters, N-acyl-N-alkyltauric acid, sulfosuccinic acid esters, sulfoalkylpolyoxyethylene alkylphenyl ethers, polyoxyethylene alkylphosphoric acid esters and so on; amphoteric surface active agents such as amino acids, aminoalkylsulfonic acids, aminoalkylsulfuric or phosphoric acid esters, alkyl betaines, amine imides, amine oxides and so on; cationic surface active agents such as alkylamine salts, aliphatic or aromatic quaternary ammonium salts, heterocyclic quaternary ammonium salts, e.g., pyridinium, imidazolium, etc., aliphatic or hetero ring-containing phosphonium or sulfonium salts, and so on; and fluorine-containing surface active agents (including anion, nonion, cation and betaine types).

Specific examples of these surface active agents are described in U.S. Pat. Nos. 2,240,472; 2,831,766; 3,158,484; 3,210,191; 3,294,540; 3,507,660; 2,739,891; 2,823,123; 3,068,101; 3,415,649; 3,666,478; 3,756,828; 3,133,816; 3,441,413; 3,475,174; 3,545,974; 3,726,683; 3,843,368; 2,271,623; 2,288,226; 2,944,900; 3,253,919; 3,671,247; 3,722,021; 3,589,906; 3,666,478 and 3,574,924; British Pat. Nos. 1,012,495; 1,022,878; 1,179,290; 1,198,450; 1,397,218; 1,138,514; 1,159,825; 1,374,780; 1,507,961 and 1,503,218; Belgian Pat. No. 731,126; German Patent Application (OLS) No. 1,961,638; German Patent Application No. 2,556,670, Japanese Patent Application (OPI) Nos. 117414/75, 59025/75, 21932/78 and 77135/77 (the term "OPI" as used herein refers to a "published unexamined Japanese patent application") and so on.

As colloidal silica, Ludox AM (product of E. I. Du Pont de Nemours & Co. Inc.), SNOW Tex O (product of Nissan Chemicals Industries, Ltd.) and other commercial ones can be used.

The antistatic layer of the present invention can be applied to a photographic light-sensitive material using a conventional technique which has been used for coating an aqueous coating composition. Examples of such a technique include a dip coating technique, an air knife coating technique, a curtain coating technique, a spray coating technique, an extrusion coating technique using a hopper or a slide hopper coating process, and so on.

Photographic light-sensitive materials to which the method of preventing adverse effects due to static electricity by providing such an antistatic layer as described above can be advantageously applied may include negative films, reversal films, photographic paper and so on, whether they are color materials or not.

Suitable examples of supports for these photographic light-sensitive materials include a cellulose acetate film, a cellulose nitrate film, a polyvinyl acetal film, a polycarbonate film, a polyester film, a polystyrene film, baryta paper, and photographic printing paper coated with polystyrene, cellulose acetate, polyester, polyolefin or the like.

When the antistatic layer of the present invention is coated on a polyester film, it is effective to provide a subbing layer between the film and the antistatic layer in order to improve adhesiveness of the antistatic layer to the film. Various techniques for providing an effective subbing layer are well known, and the present invention does not place any particular limitations thereon. In addition, the present invention is not restricted in the position at which the antistatic layer is to be provided. For instance, when the antistatic layer is provided on the back side of a support, the antistatic layer may have a protecting layer thereon, or may be the outermost layer. On the other hand, when the antistatic layer is provided on the emulsion-coated side, it may be provided at the position adjacent to a subbing layer, as the surface protecting layer being the topmost layer, or at the position adjacent to the surface protecting layer. Further, combinations of the above-described positions are also effective, and the antistatic layer can be provided without being limited to one layer or one side. However, it is preferable for the antistatic layer to be provided as a backing layer, as a protecting layer for a backing layer, and/or a surface protecting layer on the light-sensitive emulsion-coated side.

Light-sensitive emulsion layers of photographic light-sensitive materials to which the present invention relates are described in detail below.

Silver halides which may be used in the emulsion of the photographic light-sensitive material of the present invention include all silver halides commonly used, e.g., silver chloride, silver bromide, silver bromoiodide, silver chlorobromide, silver chloriodide, silver chlorobromoiodide and mixtures of two or more thereof.

Hydrophilic colloids are generally employed as the binder. Typical examples of such colloids include proteins like gelatin and the derivatives thereof; polysaccharide such as cellulose derivative, starch and the like; sugars such as dextran and the like; vegetable rubber; and synthetic macromolecular substances such as polyvinyl alcohol, polyacrylamide, polyvinyl pyrrolidone and the like.

In addition, the photographic light-sensitive material of the present invention can contain commonly used additives, such as an antifogging agent, a photographic stabilizing agent, a sensitizer, a development modifier, a hardener, a plasticizer, a surface active agent, color couplers, polymer latex and so on.

Details of these additives are described in, e.g., *Research Disclosure*, Vol. 176, pp. 22–29 (December, 1978).

The present invention will now be illustrated in greater detail by reference to the following examples. However, the invention is not intended to be construed as being limited to these examples.

EXAMPLE 1

On both sides of an about 175μ thick polyethylene terephthalate film were coated emulsion layers and protecting layers. The respective compositions of these layers are described below. The layers were coated in this order and then dried to prepare a sample (1).

(I) Emulsion layer (about 5μ thick) containing 2.5 g/m$^2$ of gelatin as a binder, a silver iodobromide in a coated amount of silver of 5 g/m$^2$ (containing 1.5 mol% of silver iodide and 98.5 mol% of silver bromide), 0.8 g per 100 g gelatin of chrome alum as a hardener and 0.5 g per 100 g silver of 1-phenyl-5-mercaptotetrazole as an antifoggant.

(II) Protecting layer (about 1μ thick) containing as a binder 1.7 g/m$^2$ of gelatin and 0.3 g/m$^2$ of potassium polystyrenesulfonate (mean molecular weight=about 70,000), and as a coating agent 7 mg/m$^2$ of sodium N-oleoyl-N-methyltaurine.

Samples (2) to (7) were prepared in the same manner as in the sample (1) except that polymers set forth in Table 1 were added to their individual protecting layers in addition to the above-described composition. Antistatic properties of these samples were examined according to the following processes.

(a) Measurement of specific surface resistance

After the sample was allowed to stand for 2 hours in the atmosphere of 25° C. and 25% RH in order to condition the humidity thereof, the test piece was interposed between electrodes made of brass and having a spacing of 0.14 cm and a length of 10 cm (wherein the parts to come into contact with a test piece were made of stainless steel) under the same atmosphere condition. The specific surface resistance corresponding to the one minute value was measured using an electrometer made by Takeda Riken Co., Ltd. (TR-8651).

(b) Measurement of degree of occurrence of static mark

After an unexposed sample was subjected to humidity adjustment in the atmosphere of 25° C. and 25% RH, a sample was placed in a dark room under the same atmospheric condition. The sample was then rubbed with a rubber roller, developed with a developing solution described below, fixed and washed with water. The degree of static mark which occurred on the thus-processed sample was examined.

| Composition of Developing Solution | |
|---|---|
| Hot Water | 800 ml |
| Sodium Tetrapolyphosphate | 2.0 g |
| Anhydrous Sodium Sulfite | 50 g |
| Hydroquinone | 10 g |
| Sodium Carbonate (monohydrate) | 40 g |
| 1-Phenyl-3-pyrazolidone | 0.3 g |
| Potassium Bromide | 2.0 g |
| Water to make | 1,000 ml (pH 10.2) |

TABLE 1

| Sample No. | Antistatic Agent | Addition Amount Based on Carboxylic Acid Content (mole/100 g gelatin in protecting layer) | Binder of Carboxylic Acid Activatable Type |
|---|---|---|---|
| 1 (Comparison) | Absent | 0 | Absent |
| 2 (Comparison) | Comparative Compound A | 0.1 | Absent |
| 3 (Comparison) | Comparative Compound A | 0.2 | Absent |
| 4 (Comparison) | Comparative Compound A | 0.4 | Absent |
| 5 (Comparison) | Comparative Compound A | 0.1 | Condensate B |
| 6 (Comparison) | Comparative Compound A | 0.2 | Condensate B |
| 7 (Comparison) | Comparative Compound A | 0.4 | Condensate B |
| 8 (Invention) | Polymer Compound P-1 | 0.1 | Absent |
| 9 (Invention) | Polymer Compound P-1 | 0.2 | Absent |
| 10 (Invention) | Polymer Compound P-1 | 0.4 | Absent |

In Table 1, the comparative compound A is sodium polyacrylate, the condensate B of carboxylic acid activatable type is benzenesulfonic acid succinimide ester and its addition amount is 3 wt% to the amount of the comparative compound A added together therewith, and the polymer compound P-1 is

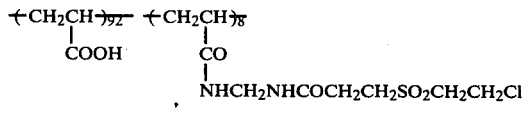

Next, each of these unexposed samples were exposed to a tungsten lamp with an exposure amount of 1.6 CHM through a filter SP-14 (made by Fuji Photo Film CO., Ltd.), developed with the above-described developing solution at 35° C. for 30 seconds, fixed and washed with water. The sensitivities of the thus-processed samples and the degrees of fog which occurred thereon were measured. Separately, these unexposed samples were allowed to stand at 50° C. for 3 days and then exposed and processed under the same conditions as described above. The sensitivities and the degrees of fog of the thus-processed samples were measured, and influences of the added compounds upon photographic characteristics were examined.

Film strength of these samples was examined as follows: After each of samples constituted with coated layers was dipped in an RD-III developing solution at 35° C. for 25 seconds, a stylus on the top of which a stainless steel ball having a diameter of 0.8 mm was mounted was pressed on the surface of each of the thus development-processed samples. The ball was moved thereon as the load imposed on the stylus was continuously increased till the sample surface was torn (or scratched). Theu, the film strength was represented by the load at the point of tearing. The results obtained are shown in Table 2.

TABLE 2

| Sample No. | Antistatic Properties: Specific Surface Resistance (Ω) | Antistatic Properties: Degree of Static Mark Occurrence | Photographic Properties: Just after Coating: Fog | Photographic Properties: Just after Coating: Sensitivity | Photographic Properties: After 3 Days' Storage at 50° C.: Fog | Photographic Properties: After 3 Days' Storage at 50° C.: Sensitivity | Film Strength: 60% RH, 25° C. after 5 Days' Storage | Film Strength: 50° C. after 3 Days' Storage |
|---|---|---|---|---|---|---|---|---|
| 1 | $1.0 \times 10^{14}$ or more | D | 0.16 | — | 0.15 | −0.01 | 96 | 105 |
| 2 | $3.6 \times 10^{14}$ | C | 0.16 | 0.00 | 0.15 | −0.02 | 84 | 93 |
| 3 | $2.0 \times 10^{13}$ | B | 0.16 | 0.00 | 0.14 | −0.01 | 70 | 81 |
| 4 | $1.2 \times 10^{13}$ | B | 0.17 | 0.00 | 0.14 | −0.01 | 53 | 60 |
| 5 | $3.4 \times 10^{14}$ | C | 0.16 | 0.00 | 0.15 | −0.01 | 86 | 99 |
| 6 | $2.1 \times 10^{13}$ | B | 0.16 | 0.00 | 0.14 | −0.01 | 78 | 89 |
| 7 | $1.2 \times 10^{13}$ | B | 0.16 | 0.00 | 0.14 | −0.01 | 65 | 82 |
| 8* | $2.0 \times 10^{13}$ | B | 0.16 | 0.00 | 0.14 | −0.01 | 96 | 107 |
| 9* | $7.9 \times 10^{12}$ | A | 0.16 | 0.00 | 0.15 | −0.01 | 98 | 110 |
| 10* | $3.2 \times 10^{12}$ | A | 0.16 | 0.00 | 0.15 | −0.02 | 101 | 112 |

*Samples prepared in accordance with embodiments of the present invention.

The degree of static mark occurrence set forth in Table 2 is an evaluation carried out by dividing the observed amount of static mark occurrence into the following four ranks:

Rank A: Occurrence of static mark was not observed at all.

Rank B: Occurrence of static mark was observed to a small degree.

Rank C: Occurrence of static mark was observed to a considerable degree.

Rank D: Occurrence of static mark was observed almost all over the surface.

In order to evaluate the sensitivity, the sensitivity just after coating of the controlled sample (sample (1)) was taken as a standard, and the deviation of the sensitivity in question from this standard was expressed in the term of the absolute value of log E. Accordingly, no deviation from the standard sensitivity indicates no influences upon photographic properties.

Antistatic properties, influences upon photographic properties and film strengths of these samples each are also summarized in Table 2.

As can be seen from Table 2, the antistatic properties are markedly improved by the use of the compound of the present invention even in relatively small amounts. In addition, it was found that the film strength was not lowered or easily influenced by storage conditions due to the use of the compounds of the present invention.

EXAMPLE 2

On a cellulose triacetate film support were coated an antihalation layer, a red-sensitive emulsion layer, an interlayer, a green-sensitive emulsion layer, a yellow filter layer, a blue-sensitive emulsion layer and a protecting layer, which are described below, in this order, and dried to prepare a sample (No. 11).

(1) Antihalation layer containing 4.4 g/m$^2$ of gelatin as a binder, 5 g per 100 g binder of 1,3-bis(vinylsulfonyl)-2-hydroxypropane as a hardener, 4 mg/m$^2$ of sodium dodecylbenzenesulfonate as a coating aid, and 0.4 g/m$^2$ of black colloidal silver as an antihalation component.

(2) Red-sensitive emulsion layer containing 7 g/m$^2$ of gelatin as a binder, 0.7 g per 100 g binder of sodium salt of 2-hydroxy-4,6-dichloro-s-triazine and 2 g per 100 g binder of 1,3-bis(vinylsulfonyl)-2-hydroxypropane as a hardener, 10 mg/m$^2$ of sodium dodecylbenzenesulfonate as a coating aid, silver iodobromide (containing 2 mol% of AgI and 98 mol% of AgBr) in a coated amount of silver of 3.1 g/m$^2$, 0.9 g per 100 g silver of 4-hydoxy-6-methyl-1,3,3a,7-tetraazaindene as an antifoggant, 38 g per 100 g silver of 1-hydroxy-4-(2-acetylphenyl)azo-N-[4-(2,4-di-tert-amylphenoxy)butyl]-2-naphthoamide as a color forming agent, and 0.3 g per 100 g silver of pyridinium salt of anhydro-5,5'-dichloro-9-ethyl-3,3'-di(3-sulfopropyl)thiacarbocyanine hydroxide as a sensitizing dye.

(3) Interlayer containing 2.6 g/m$^2$ of gelatin as a binder, 6 g per 100 g binder of 1,3-bis(vinylsulfonyl)-2-hydroxypropane as a hardener, and 12 mg/m$^2$ of sodium dodecylbenzenesulfonate as a coating aid.

(4) Green-sensitive emulsion layer containing 6.4 g/m$^2$ of gelatin as a binder, 0.7 g per 100 g binder of sodium salt of 2-hydroxy-4,6-dichloro-s-triazine and 2 g per 100 g binder of 1,3-bis(vinylsulfonyl)-2-hydroxypropane as a hardener, 9 mg/m$^2$ of sodium dodecylbenzenesulfonate as a coating aid, silver iodobromide (containing 3.3 mol% of AGI and 96.7 mol% of AgBr) in a coated amount of silver of 2.2 g/m$^2$, 0.6 g per 100 g silver of 4-hydroxy-6-methyl-1,3,3a,7-tetraazaindene as a stabilizer, 37 g per 100 g silver of 1-(2,4,6-trichlorophenyl)-3-{3-[(2,4-di-tert-amylphenoxy)acetoazido]}-4-(4-methoxyphenyl)azo-5-pyrazolone as a color forming agent, and 0.3 g per 100 g silver of pyridinium salt of anhydro-5,5'-diphenyl-9-ethyl-3,3'-di(2-sulfoethyl)oxacarbocyanine hydroxide as a sensitizing dye.

(5) Yellow filter layer containing 2.3 g/m$^2$ of gelatin as a binder, 0.7 g/m$^2$ of yellow colloidal silver as a filtering component, 5 g per 100 g binder of 1,3-bis(vinylsulfonyl)-2-hydroxypropane as a hardener, and 7 mg/m$^2$ of sodium salt of 2-sulfonatosuccinic acid bis-(2-ethylhexyl) ester as a surface active agent.

(6) Blue-sensitive emulsion layer containing 7 g/m$^2$ of gelatin as a binder, 0.7 g per 100 g binder of sodium salt of 2-hydroxy-4,6-dichloro-s-triazine and 2 g per 100 g binder of 1,3-bis(vinylsulfonyl)-2-hydroxypropane as a hardener, 8 mg/m$^2$ of sodium dodecylbenzenesulfonate as a coating aid, silver iodobromide (containing 3.3 mol% of AgI and 96.7 mol% of AgBr) in a coated amount of silver of 2.2 g/m$^2$, 0.4 g per 100 g silver of 4-hydroxy-6-methyl-1,3,3a,7-tetraazaindene as a stabilizer, and 45 g per 100 g silver of 2'-chloro-5'-[2-(2,4-di-tert-amylphenoxy)butyramido]-α-(5,5'-dimethyl-2,4-dioxo-3-oxazolydinyl)-α-(4-methoxybenzoyl)acetanilide as a color forming agent.

(7) Protecting layer containing 2 g/m$^2$ of gelatin and 0.3 g/m$^2$ of styrene-maleic anhydride (1:1) copolymer having a mean molecular weight of about 100,000 as a binder, 5 g per 100 g binder of 1,3-bis(vinylsulfonyl)-2-hydroxypropane as a hardener, and 5 mg/m of sodium dioctylsulfosuccinate as a coating aid.

Samples No. 12 and No. 13 were prepared in the same manner as in the sample No. 11 except that the compound P-1 of the present invention and a comparative compound A (sodium polyacrylate) were added in an amount of 600 mg/m$^2$ to the protecting layer, respectively, in addition to the above-described components. Antistatic properties of these samples were examined in the same manner as in Example 1 except that a usual color development-processing was carried out instead of the white-and-black development-processing. The results obtained are shown in Table 3.

TABLE 3

| Sample No. | Antistatic Agent | | Specific Surface Resistance (Ω) | Degree of Static Mark Occurrence |
|---|---|---|---|---|
| 11 | Absent | Control | $8.0 \times 10^{12}$ | D |
| 12 | Compound P-1 | Present Invention | $5.0 \times 10^{11}$ | A |
| 13 | Compound A | Comparison | $4.2 \times 10^{12}$ | B |

It is apparent from the results of Table 3 that the sample using the compound of the present invention has reduced surface resistance and hardly generates any static marks. On the other hand, when these samples were each subjected to exposure based on Japanese Industrial Standard and subsequently to a usual color development-processing, sample No. 13 using the comparative compound A causes remarkable desensitization in its blue-, green- and red-sensitive emulsion layers. However, the compound of the present invention had almost no adverse effect on photographic properties of the photographic light-sensitive material.

EXAMPLE 3

A backing layer and a back protecting layer, which are described below, were coated on one side of a cellulose triacetate film support. On the other side thereof was coated a color light-sensitive layer having the same multilayer structure as the control sample (the sample No. 11) in Example 3.

(1') Backing layer containing 6.2 g/m$^2$ of gelatin as a binder, 0.1 g/m$^2$ of potassium nitrate as a salt, and 0.6 g per 100 g binder of 1,3-bis(vinylsulfonyl)-2-hydroxypropane as a hardener.

(2') Back protecting layer containing 2.2 g/m$^2$ of gelatin as a binder, 20 mg/m$^2$ of polymethyl methacrylate (having a mean grain size of 2.5μ) as a matting agent, 1.2 g per 100 g binder of 1,3-bis(vinylsulfonyl)-2-hydroxypropane as a hardener, and 40 mg/m$^2$ of sodium dioctylsulfosuccinate as a coating aid.

The thus-prepared sample was named sample No. 14. In addition to the above-described composition, antistatic agents set forth in Table 4 were added in an amount of 660 mg/m$^2$ to the separate backing layers to prepare a sample No. 15 and a sample No. 16, respectively.

The specific surface resistance of the back surface of these samples each was examined in the same manner in Example 1. The results obtained are shown in Table 4.

TABLE 4

| Sample No. | Antistatic Agent | | Specific Surface Resistance (Ω) |
|---|---|---|---|
| 14 | Absent | Control | $7.2 \times 10^{13}$ |
| 15 | Compound P-1 | Present Invention | $2.8 \times 10^{10}$ |
| 16 | Compound A | Comparison | $6.8 \times 10^{12}$ |

As can be seen from Table 4, the specific surface resistance is markedly reduced by the use of the compound of the present invention. That is, the compound of the present invention has proved to be an effective antistatic agent.

EXAMPLE 4

In order to examine the formation of scum in a fixing solution, each of the samples (1), (4), (7) and (10), which were prepared in Example 1, was processed using a simple automatic developing machine made by Fuji Photo Film Co., Ltd. (trade name: Fuji X-ray processor RE-3, developing solution volume: 2 liter, and fixing solution volume: 2 liter) till the processed area became about 12 $m^2$. The condition of the fixing solution was then observed. The results of such a scum test are shown in Table 5. Therein, the developing solution used was a medical X-ray film processing agent "Fuji RD-III" made by Fuji Photo Film Co., Ltd., and the fixing solution used was "Fuji F" made by the same company.

TABLE 5

| Sample | | Occurrence of Scum in Fixing Solution |
|---|---|---|
| Sample (1) | Control | Does not occur |
| Sample (4) | Comparison | Occurs |
| Sample (7) | Comparison | Little occurs |
| Sample (10) | Present Invention | Does not occur |

In Table 5, sample (4) shows that the comparative compound A causes occurrence of scum in the fixing solution, sample (7) shows that the condensate (B) somewhat prevents the occurrence of scum and sample (10) shows that the polymer compound P-1 completely prevents the occurrence of scum.

Thus, from the results shown in Table 5, it can be seen that the sensitive material using the compound of the present invention does not generate scum in the fixing solution.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material, comprising:

a support base;

a silver halide emulsion layer; and an antistatic emulsion layer comprising a gelatin having dispersed therein a polymer having repeating units represented by the following general formula (I):

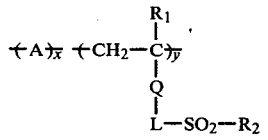

(I)

wherein A represents a repeating unit derived from a copolymerizable ethylenic unsaturated monomer which contains at least one free carboxyl group or a salt thereof; $R_1$ represents a hydrogen atom or a lower alkyl group having 1 to 6 carbon atoms; Q represents $—CO_2—$,

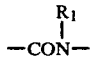

or an arylene group having 6 to 10 carbon atoms; L represents a divalent group having 3 to 15 carbon atoms and containing at least one linkage selected from the group consisting of $—CO_2—$ and

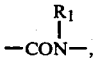

or a divalent group having 1 to 12 carbon atoms and containing at least one linkage selected from the group consisting of —O—,

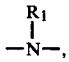

—CO—, —SO—, $—SO_2—$, $—SO_3—$,

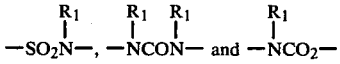

(wherein $R_1$ has the same meaning as described above); $R_2$ represents $—CH{=}CH_2$ or $—CH_2CH_2X$ (wherein X represents a group capable of being substituted with a nucleophilic group or a group capable of being released in a form of HX upon a base); and x and y represent percentages by mole fraction ranging from 50 to 99, and 1 to 50, respectively.

2. The photographic light-sensitive material as claimed in claim 1, wherein A is a repeating unit derived from an ethylenic unsaturated monomer selected from the group consisting of: acrylic acid, methacrylic acid, itaconic acid, maleic acid, sodium acrylate, potassium acrylate, sodium methacrylate,

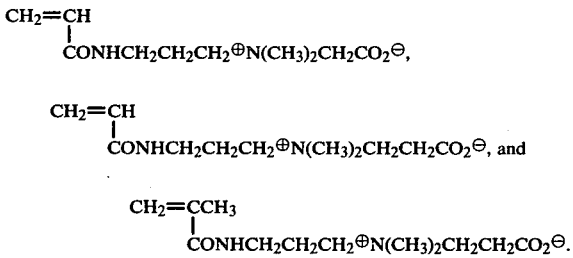

3. The photographic light-sensitive material as claimed in claim 1, wherein A is a repeating unit derived from acrylic acid, methacrylic acid or maleic acid.

4. The photographic light-sensitive material as claimed in claim 1, wherein $R_1$ is a hydrogen atom or a methyl group.

5. The photographic light-sensitive material as claimed in claim 2, wherein $R_2$ is selected from the group consisting of $—CH{=}CH_2$, $—CH_2CH_2Br$, $—CH_2CH_2Cl$, and

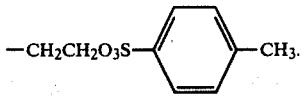

6. The photographic light-sensitive material as claimed in either of claims 1 or 3, wherein the polymer is present in an amount of from 10 wt% to 90 wt% based on the total weight of the antistatic emulsion layer.

7. The photographic light-sensitive material as claimed in claim 4, wherein the polymer is present in an amount of from 20 wt% to 70 wt% based on the total weight of the antistatic emulsion layer.

* * * * *